US006453682B1

(12) United States Patent
Jennings et al.

(10) Patent No.: US 6,453,682 B1
(45) Date of Patent: Sep. 24, 2002

(54) POINT-OF-SALE CHILLED PRODUCT HOUSING

(75) Inventors: Thomas A. Jennings, Winston-Salem; Theodore A. Pierce, Pfafftown; Eugene C. Pierce, Greensboro; Stephen E. Bertrand, Winston-Salem, all of NC (US)

(73) Assignee: Cold-Sell Systems, L.L.C., Winston-Salem, NC (US)

( * ) Notice: Subject to any disclaimer, the term of this patent is extended or adjusted under 35 U.S.C. 154(b) by 0 days.

(21) Appl. No.: 09/997,748

(22) Filed: Nov. 29, 2001

Related U.S. Application Data

(60) Division of application No. 09/301,709, filed on Apr. 28, 1999, which is a continuation-in-part of application No. 09/221,888, filed on Dec. 8, 1998, now Pat. No. 6,067,810.

(51) Int. Cl.[7] ..... F25D 3/06; A47F 3/04
(52) U.S. Cl. ..... 62/56; 62/246; 62/457.2
(58) Field of Search ..... 62/246, 457.1, 62/457.2, 56

(56) References Cited

U.S. PATENT DOCUMENTS

| | | | | | |
|---|---|---|---|---|---|
| 309,233 | A | | 12/1884 | Luhmann | |
| 608,701 | A | | 8/1898 | Morse | |
| 2,271,802 | A | | 2/1942 | Nordskog | 62/89.5 |
| 2,317,005 | A | | 4/1943 | Wasserman | 62/91.5 |
| 2,393,245 | A | | 1/1946 | Hadsell | 62/1 |
| 2,427,230 | A | | 9/1947 | Salzmann | 62/31 |
| 2,453,017 | A | | 11/1948 | Kaufman | 62/133 |
| 2,612,761 | A | | 10/1952 | Hilker | 62/116 |
| 3,130,163 | A | | 4/1964 | Avera | 252/67 |
| 3,254,502 | A | | 6/1966 | Ellis | 62/257 |
| 3,255,607 | A | * | 6/1966 | Bair et al. | 206/545 |
| 3,399,546 | A | | 9/1968 | Kuns et al. | 62/371 |
| 3,491,548 | A | * | 1/1970 | Christiansen | 62/246 |
| 3,807,194 | A | | 4/1974 | Bond | 62/457 |

(List continued on next page.)

FOREIGN PATENT DOCUMENTS

| | | |
|---|---|---|
| CA | 622107 | 6/1961 |
| GB | 511685 | 8/1939 |
| GB | 808690 | 2/1959 |

OTHER PUBLICATIONS

Photocopy of brochure entitled "Build Your Yogurt Business The Yoplait Way"; 1987.
New Cambro Food Bars; copyright 1994.
Photocopy of Marvel Industries brochure; copyright 1998.
Photocopy of Cambro brochure; "With the CamKiosk, Just Add Food . . . and You're in Business" 1998.

(List continued on next page.)

*Primary Examiner*—William E. Tapolcai
(74) *Attorney, Agent, or Firm*—MacCord Mason PLLC

(57) ABSTRACT

A point-of-sale display for selling containers of chilled food items includes a quadrilateral vessel having a bottom and end and side walls, the walls containing thermally insulating material. At least seven removable panels each of which contains a material that is liquid at room temperature and has a freezing point of about 32 degrees Fahrenheit or colder are configured to fit together to form vertical walls about at least one interior chamber in the vessel and sized to be placed into the vessel with two panels on opposed vessel ends, two panels each on opposed vessel sides and one panel extending between the vessel sides spaced from each vessel end, the panel extending between the vessel sides extending fully between the vessel sides and the panels on each vessel side together not extending fully along the side. The panels can be placed in a freezer below the freezing point of the liquid until the liquid freezes and then placed in the vessel to form an interior chamber in the vessel. Containers of food items to be sold may be loaded into the interior chamber and kept cold by their proximity to the panels.

12 Claims, 9 Drawing Sheets

U.S. PATENT DOCUMENTS

| | | | | | |
|---|---|---|---|---|---|
| 3,974,658 | A | | 8/1976 | Starrett | 62/60 |
| 4,176,747 | A | | 12/1979 | Aho | 206/509 |
| 4,220,048 | A | | 9/1980 | Grepiotis et al. | 73/323 |
| 4,225,059 | A | | 9/1980 | Kappos | 222/146 |
| 4,292,817 | A | | 10/1981 | Loucks | 62/457 |
| 4,319,629 | A | * | 3/1982 | Hotta | 165/47 |
| 4,324,111 | A | | 4/1982 | Edwards | 62/457 |
| 4,344,301 | A | | 8/1982 | Taylor | 62/457 |
| 4,348,827 | A | | 9/1982 | Brinker | 40/607 |
| 4,399,668 | A | | 8/1983 | Williamson | 62/457 |
| 4,441,336 | A | | 4/1984 | Cannon | 62/457 |
| 4,498,312 | A | * | 2/1985 | Schlosser | 62/371 |
| 4,505,132 | A | | 3/1985 | Howers et al. | 62/457 |
| 4,651,538 | A | | 3/1987 | Bull et al. | 62/398 |
| 4,722,199 | A | | 2/1988 | Hibino | 62/344 |
| 4,724,682 | A | | 2/1988 | Flum et al. | 62/462 |
| 4,775,002 | A | | 10/1988 | Iwamoto | 165/47 |
| 4,910,975 | A | | 3/1990 | Derby | 62/372 |
| 4,923,077 | A | | 5/1990 | Van Iperen et al. | 220/3.1 |
| 4,941,327 | A | | 7/1990 | Miles | 62/246 |
| 4,946,032 | A | | 8/1990 | Stoddard et al. | 206/44 |
| 4,982,840 | A | | 1/1991 | Bidwell et al. | 206/223 |
| 4,995,238 | A | | 2/1991 | King | 62/125 |
| 5,048,171 | A | | 9/1991 | Bidwell et al. | 29/401.1 |
| 5,101,642 | A | | 4/1992 | Alexandrov | 62/371 |
| 5,159,973 | A | | 11/1992 | Pennington et al. | 165/48.1 |
| 5,169,020 | A | | 12/1992 | Spamer | 220/444 |
| 5,240,125 | A | | 8/1993 | Kunz | 211/59.3 |
| 5,261,253 | A | | 11/1993 | Spenard | 62/250 |
| 5,313,807 | A | | 5/1994 | Owen | 62/457 |
| 5,351,839 | A | | 10/1994 | Beeler et al. | 211/59.3 |
| 5,433,085 | A | | 7/1995 | Rogers | 62/372 |
| 5,493,874 | A | | 2/1996 | Landgrebe | 62/457.2 |
| 5,494,195 | A | | 2/1996 | Knuettel, II et al. | 222/146.6 |
| 5,584,188 | A | | 12/1996 | Tippmann et al. | 62/239 |
| 5,596,880 | A | | 1/1997 | Welker et al. | 62/372 |
| 5,598,943 | A | * | 2/1997 | Markus | 206/545 |
| 5,669,233 | A | * | 9/1997 | Cook et al. | 62/371 |
| 5,704,485 | A | | 1/1998 | Cautereels et al. | 206/546 |
| 5,924,302 | A | | 7/1999 | Derifield | 62/457.2 |
| 5,927,092 | A | | 7/1999 | Kushen et al. | 62/258 |
| 5,953,931 | A | | 9/1999 | Brittain | 62/272 |
| 5,996,842 | A | | 12/1999 | Riley et al. | 222/1 |
| 6,010,043 | A | | 1/2000 | Williamson et al. | 222/608 |
| 6,067,810 | A | | 5/2000 | Jennings et al. | 62/246 |
| 6,073,547 | A | | 6/2000 | Westbrooks, Jr. et al. | 99/468 |
| 6,105,825 | A | | 8/2000 | Gomi et al. | 222/146.6 |
| 6,116,029 | A | | 9/2000 | Krawec | 62/3.3 |
| 6,151,910 | A | | 11/2000 | Hazen | 62/457.2 |
| 6,209,343 | B1 | | 4/2001 | Owen | 62/457.2 |
| 6,237,765 | B1 | | 5/2001 | Hagen et al. | 206/315.11 |
| 6,244,458 | B1 | | 6/2001 | Frysinger et al. | 220/592.09 |

OTHER PUBLICATIONS

Photocopy of brochure entitled "CamKiosk Features" copyright 1998.

Photocopy of one page ad entitled "Serving Milk Is Way Cool" copyright 2000.

Photocopy of one page ad for "Cold Bag" Versa–Flex Single & Double Crates; undated.

Photocopy of Cambro Unit as displayed at CSFSA Apr. 18, 2000.

Photocopy of photographs of Insul–Ice; undated.

Letter from George Bethel dated Jul. 2, 2000 discussing applicability of references to the claims.

Letter from George Bethel dated Aug. 23, 2000 discussing applicability of reference to the claims.

Copy of Protest filed Aug. 24, 2000.

* cited by examiner

POINT-OF-SALE CHILLED PRODUCT HOUSING

This application is a divisional of U.S. patent application Ser. No. 09/301,709 filed Apr. 28, 1999, which is a continuation-in-part of U.S. application Ser. No. 09/221,888 filed Dec. 8, 1998. now U.S. Pat. No. 6,067,810.

BACKGROUND OF THE INVENTION

The present invention is primarily directed toward a device for use as a point-of-sale housing, but may also find application outside of retail environments.

Conventionally, for keeping temperature-sensitive foodstuffs, especially beverages, chilled, an electrically refrigerated cabinet has been used. More recently, convenience stores have used point-of-sale insulated containers filled with iced-down beverages. There are numerous problems associated with either method of cooling individually packaged beverages.

Electrically refrigerated cabinets tend to be large, heavy, cumbersome units that are not mobile and need electricity. These cabinets generally require a substantial capital investment and can require expensive periodic maintenance. If the unit fails or a power outage occurs, the units are ineffective during the interim.

As a solution to the aforementioned shortcomings of an electrically refrigerated unit, insulated beverage coolers have been made that chill the beverages with ice in an attractive, mobile display. These coolers generally include tubs that hold individually packaged beverages together with ice, keeping the beverages in contact with the ice and cooled. Although these coolers are generally more mobile and convenient than electrically powered, refrigerated units, they also have drawbacks.

Placing food or beverages on ice, although the food or beverage may be individually packaged, provides the opportunity for contamination of the container of the food or beverage by germs from customers transmitted by melted ice. Sometimes the preferred product is packaged in a carton, like milk, and the carton becomes soggy after prolonged contact in ice and melted water. The melted ice may splash out of the cooler, thus creating a slip-and-fall hazard. The beverages may eventually become completely immersed within the ice and water. This is uncomfortable and inconvenient for the customer selecting a beverage, and also presents a health risk due to the spread of germs within the ice and water mixture. The accumulation of water as a cooling medium has the undesirable effect of impairing the degree of sanitation achievable and maintainable. There is a need, therefore, for a chilled beverage container that can maintain the required cooling effect on its contents while being mobile, efficient, sanitary, and inexpensive.

SUMMARY OF THE INVENTION

The present invention fulfills this need in the art by providing a point-of-sale display including a vessel having a bottom and peripheral side walls for selling containers of chilled food items. The side walls contain thermally insulating material. A plurality of removable panels each contains a material that is liquid at room temperature and has a freezing point of about 32 degrees Fahrenheit or colder, and the panels are configured to fit together to form vertical walls about at least one interior chamber in the vessel. The panels can be placed in a freezer at a temperature below the freezing point of the liquid until the liquid freezes, and then placed in the vessel to form an interior chamber in the vessel.

Containers of food items (including, without limitation, beverages) to be sold may be loaded into the interior chamber and kept cold by their proximity to the panels. The bottom of the vessel may also contain thermally insulating material. The vessel is generally located in a retail store at room temperature (i.e. in the range of 65–75 degrees Fahrenheit).

In one embodiment, the vessel is quadrilateral with sides and ends, and there are seven panels sized to be placed into the vessel, with one panel on each of opposed vessel ends, two panels on each of opposed vessel sides, and one panel extending between the vessel sides spaced from each vessel end. The panel extending between the vessel sides preferably extends fully between the vessel sides, and the panels on each vessel side together do not extend fully along the side, so that the panel extending between the vessel sides separates the panels on the vessel sides. Preferably the ends of the panel extending between the vessel sides are indented to receive the panels on the vessel side, providing an interfit of the panels with one another within the vessel.

A lid to cover the chilled food items and panels within the vessel may also be included.

The vessel may have an outer wall arranged to receive promotional graphics for the merchandising of chilled food items. The vessel may have a barrel-shaped external wall.

When food items are loaded in the interior chamber while chilled to 33.9 degrees Fahrenheit, and the panels are loaded after being frozen solid in a conventional freezer for 16 hours, the food items are typically kept at a temperature of below 36 degrees Fahrenheit for 27 hours, and below 41 degrees Fahrenheit for 37 hours, and below 45 degrees Fahrenheit for 44 hours.

The plurality of removable panels is preferably removable from the vessel by simply lifting vertically from the vessel once the lid (if any) is opened. This permits the panels to be returned to a freezer for re-freezing and reuse.

The invention also provides a method of selling chilled food items including locating an insulated vessel in a retail location, chilling a plurality of removable panels, each of which contains a material that is liquid at room temperature and has a freezing point of about 32 degrees Fahrenheit or colder until the liquid freezes, placing the chilled panels in the insulated vessel in a pattern to form vertical walls about at least one interior chamber in the vessel; and loading containers of food items to be sold into the interior chamber. The method includes keeping the containers of food items cold by proximity to the panels for an extended period of time so that they are available to customers in the retail location, and permitting customers to remove containers of food items from the vessel and pay for them.

The method may include maintaining a lid over the chilled panels and containers of food items in the vessel while the containers are available to the customers.

In a preferred embodiment of the method, the food items are loaded in the interior chamber while chilled to 32–35 degrees Fahrenheit, the panels are frozen overnight in a conventional freezer, and the food items are kept at a temperature within two degrees Fahrenheit of their temperature upon loading for at least 24 hours while the vessel is in a room temperature environment (up to 75 degrees Fahrenheit).

If the food items are bottled beverages, the act of loading may include loading at least 48 bottles. Alternatively, the act of loading may include loading at least 96 bottles.

If the vessel is quadrilateral, the placement of the chilled panels in the insulated vessel may include placing two panels on opposed vessel ends, two panels each on opposed vessel sides and one panel extending between the vessel sides spaced from each vessel end and interfitting the panel extending between the vessel sides with the panels on each opposed vessel side.

The method preferably includes displaying promotional graphics on an outer surface of the vessel to identify and promote the sale of the contents of the vessel.

Typically, the chilling of the plurality of removable panels takes place in a freezer location separate from the retail location but within the same building as the retail location.

The invention also provides a storage bin for storage of chilled items including a vessel having a bottom and peripheral side walls. The side walls contain thermally insulating material. A plurality of removable panels each contains a material that is liquid at room temperature and has a freezing point of about 32 degrees Fahrenheit or colder, and the panels are configured to fit together to form vertical walls about at least one interior chamber in said vessel. The panels can be placed in a freezer below the freezing point of the liquid until the liquid freezes, the panels can be placed in the vessel to form an interior chamber in the vessel, and items to be chilled may be loaded into the interior chamber and kept cold by their proximity to the panels.

BRIEF DESCRIPTION OF THE DRAWINGS

These and other aspects of the present invention will become apparent to those skilled in the art after a reading of the following description of the preferred embodiments when considered with the drawings.

DESCRIPTION OF THE PREFERRED EMBODIMENTS

Figure 1:
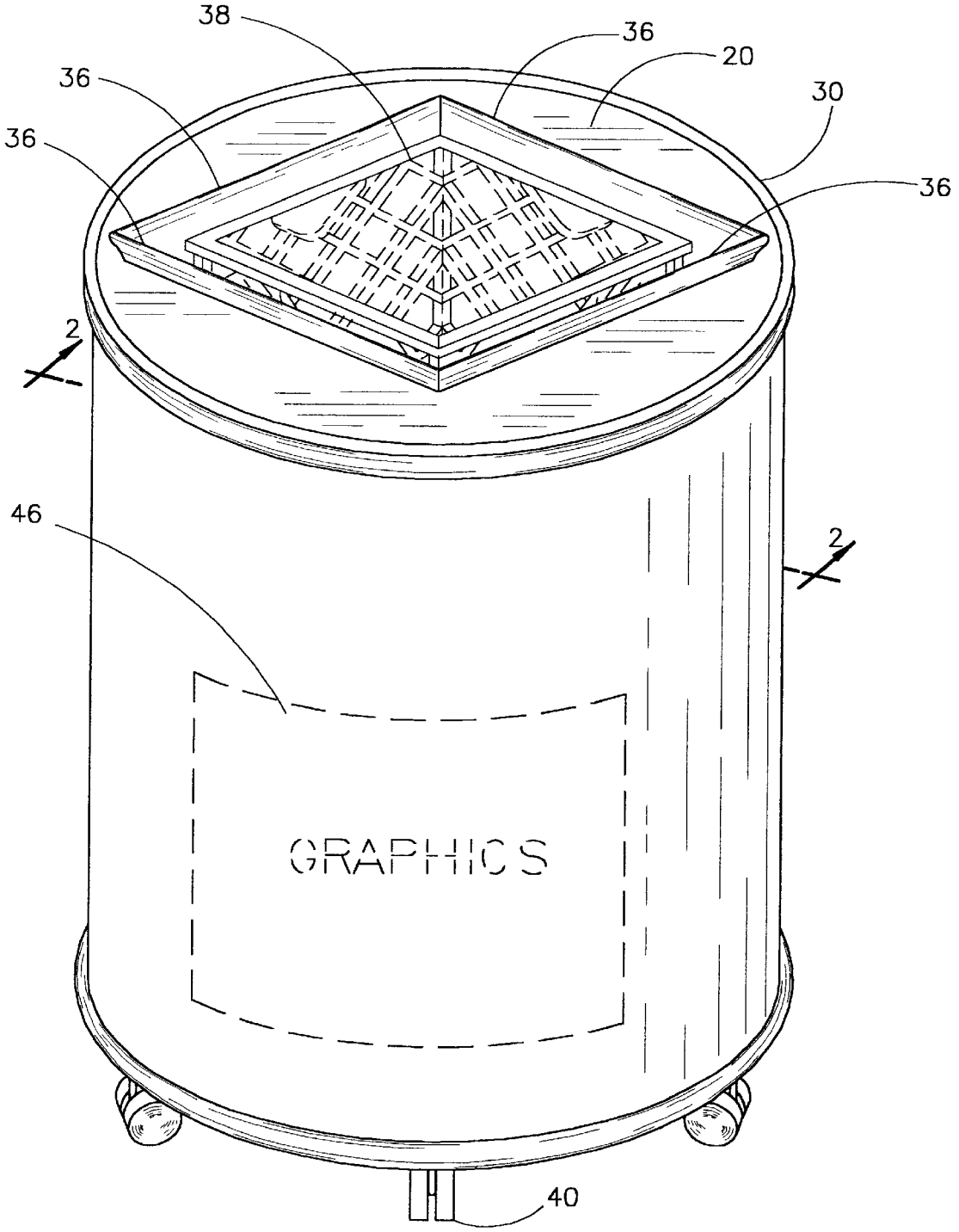
FIG. 1 is a perspective view of a chilled item server in accordance with a first embodiment of the invention.

Referring now more specifically to the drawings, FIG. 1 illustrates a first embodiment of the chilled item server 10.

Figure 2:
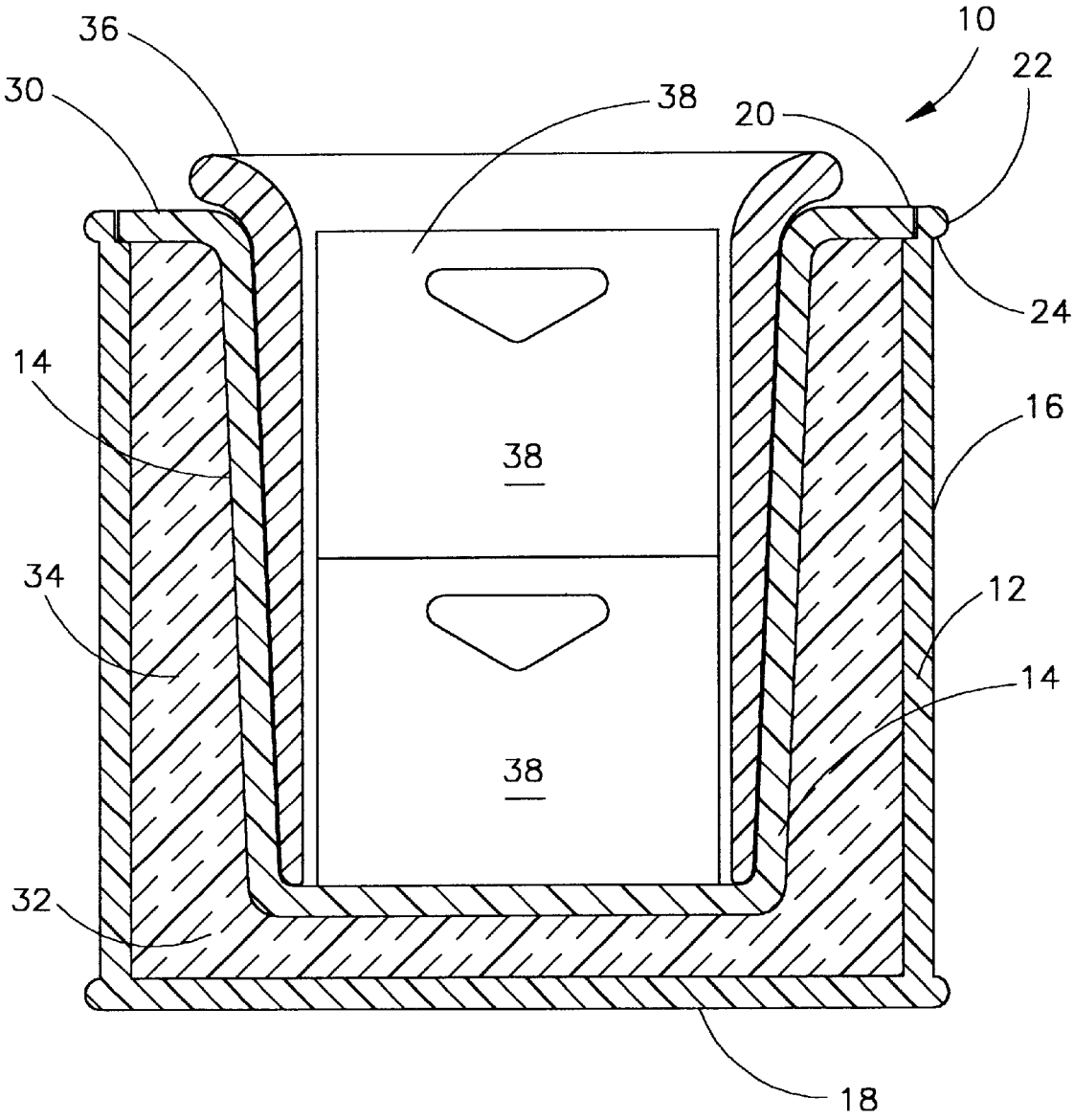
FIG. 2 is a sectional view taken along the lines 2—2 in FIG. 1 and looking in the direction of the arrows.
Figure 5:
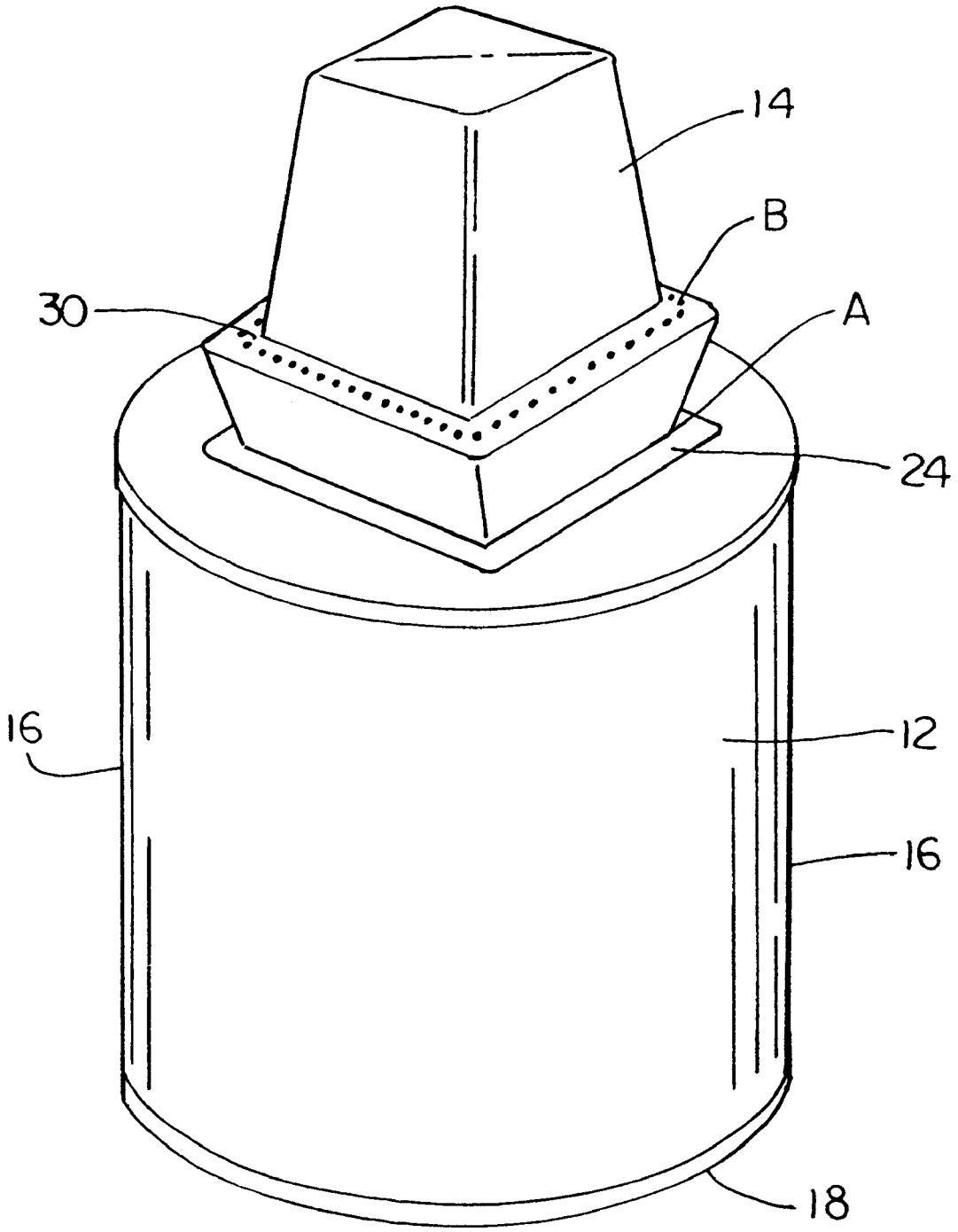
FIG. 5 is a perspective view of an intermediate blow molded item used in making the chilled item server in accordance with the first embodiment.

As shown in FIGS. 2 and 5, an outer barrel 12, and an inner liner 14 of the chilled item server 10 are constructed of any suitable material but preferably are made of thermoplastic material and most preferably polyethylene. As seen in FIGS. 1 and 2, the outer barrel 12 is substantially outwardly cylindrical and has generally vertical sides 16, a closed bottom 18 that has a flat outer surface, and an open top 20. As shown particularly in FIG. 2, the rim 22 of the outer barrel 12 is formed with an inwardly extending annular ledge 24. The annular ledge 24 may extend inwardly more than is shown in FIG. 2, as will be apparent from the discussion below with respect to FIG. 5. The outer diameter of the outer barrel 12 is preferably about 26 inches. The height of the outer barrel 12 is dependent upon the targeted consumer of the beverage to be held in the server 10. If the server 10 is to be used in an elementary school cafeteria, the height should be about 26 inches to facilitate smaller children reaching into the server 10 to get milk. For secondary and high schools, however, the outer barrel 12 is preferably about 36 inches in height. For retail establishments like convenience stores, the preferred height is 31 inches.

As shown in FIG. 2, inner liner 14 is fit within the outer barrel 12. The inner liner 14 preferably is substantially in the shape of an elongated truncated pyramid with a substantially flat bottom 28 and an extended rim 30 formed to complement the shape of opening 20 of the outer barrel 12. As shown in FIG. 2, the rim 30 of the inner liner 14 rests upon the annular ledge 24 of the outer barrel. The dimensions of the inner liner 14 are determined in part from the size of a crate 38 to be stored therein. The inner height of the inner liner 14 is preferably about 21¾ inches and the length of the substantially square inner walls is preferably about 15⅝ inches.

When the inner liner 14 and outer barrel 12 barrel fit together, a chamber 32 is created as the space between the outer surface of the inner liner 14 and the inner surface of the outer barrel 12. It is preferred that insulating material 34 fill this chamber 32. Alternatively, this space could be kept open, relying on the insulating effect of the resulting air pocket. Structural reinforcements may be added under the liner 14.

Figure 6:
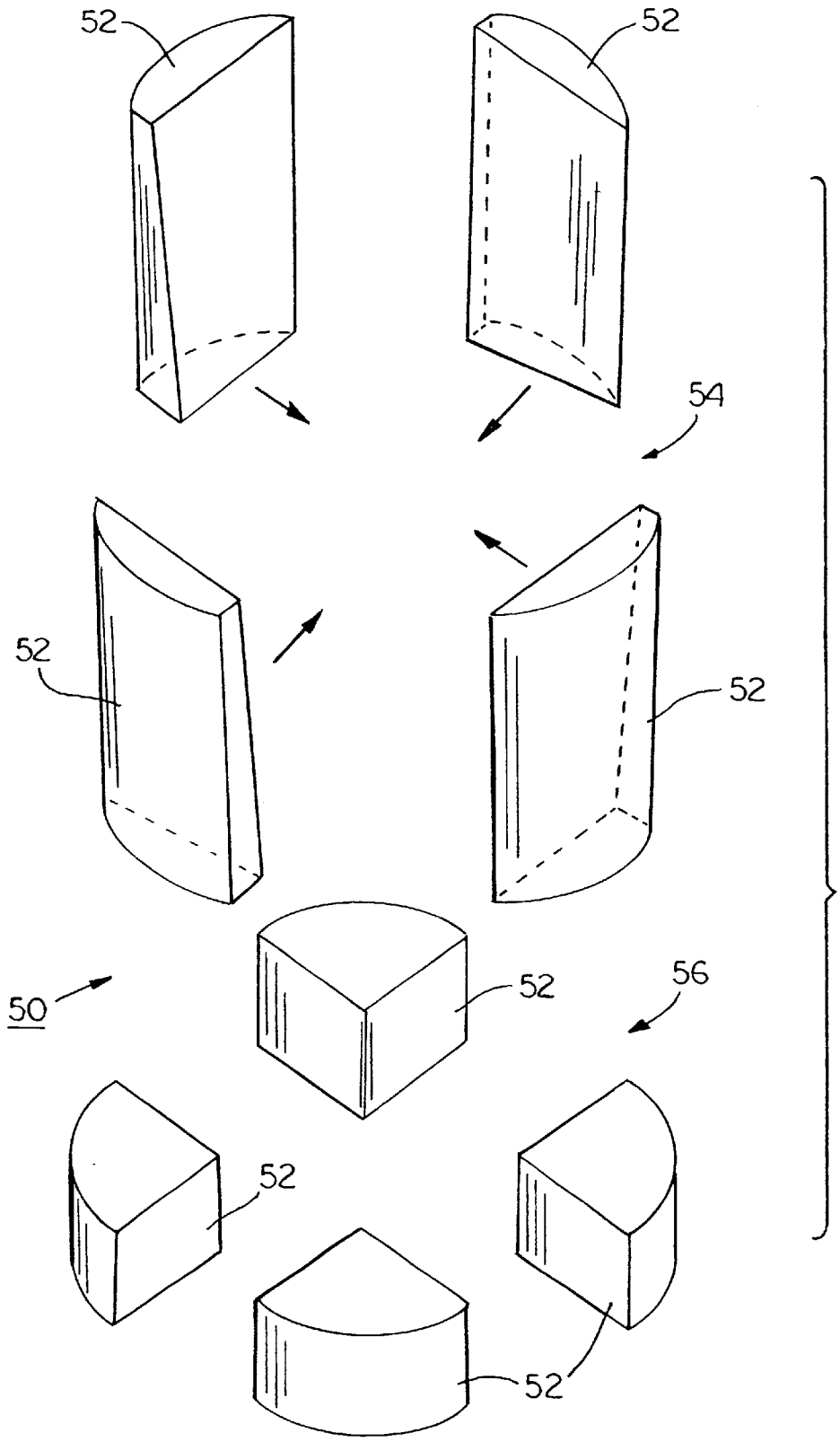
FIG. 6 is an exploded view of a preferred insulating assembly.

The preferred insulating assembly 50 is illustrated in FIG. 6. Preformed sections 52 are made by a conventional Styrofoam molding process wherein polystyrene beads having gas cores are placed in a mold of appropriate form. The polystyrene material is heated by injecting steam to expand the gas cores to form a fusing of the beads together. The preformed sections 52 are then assembled within outer barrel 12 to fill the chamber 32. The sections are appropriately formed to fit the upper 54 and base 56 sections within the chamber 32. This assembly method is preferred because the inner liner 14 is not exposed to the heat of the steam and therefore experiences little to no distortion.

Another method to make the insulating material is to use an aluminum foaming fixture of appropriate form inserted into the outer barrel 12. Again, a conventional Styrofoam molding process may be used in which polystyrene beads 34 having gas cores are placed between the fixture and the outer barrel 12 and the polystyrene material is heated by injecting steam to expand the gas cores to form a fusing of the beads together. Then, the fixture is removed and the inner liner 14 inserted into the outer barrel 12. In this manner, the inner liner 14 experiences minimal distortion due to the heat of the steam. Other insulating material and methods may be used, as will be recognized by those skilled in the art.

As shown in FIG. 5, inner liner 14 and outer barrel 12 may be formed through conventional blow molding. The outer barrel 12 is formed with annular ledge 24. The inner liner 14 and outer barrel 12 are separated at point A. Then inner liner 14 is trimmed peripherally at point B. In this manner, inner liner 14 is formed with extended rim 30 to fit annular ledge 24.

As seen in FIGS. 1 and 2, the inner liner 14 is formed of a suitable size and configuration to hold a plurality of freezer panels 36 and two conventional milk crates 38. Each freezer panel 36 preferably is formed by conventional blow molding of thermoplastic material. After forming, the freezer panel 36 is preferably filled with approximately a 2% saline water solution which freezes at about 30 degrees Fahrenheit. For use, the freezer panels 36 are frozen and placed within the inner liner 14. Each freezer panel 36 may be individually frozen. The frozen panels 36 will provide cooling of the containers of beverages placed within the server 10 due to the slow rate of thaw of the saline solution. Upon complete thawing, the thawed freezer panel is replaceable with a frozen panel, and the thawed panel may be re-frozen. The re-freezing can take place in a conventional freezer compartment, which is generally available in the school cafeteria or other location for vending chilled food items. Due to the recyclable nature of the freezer panels 36, the server provides a highly efficient and cost effective method of displaying milk for sale in school cafeterias.

Figure 3:
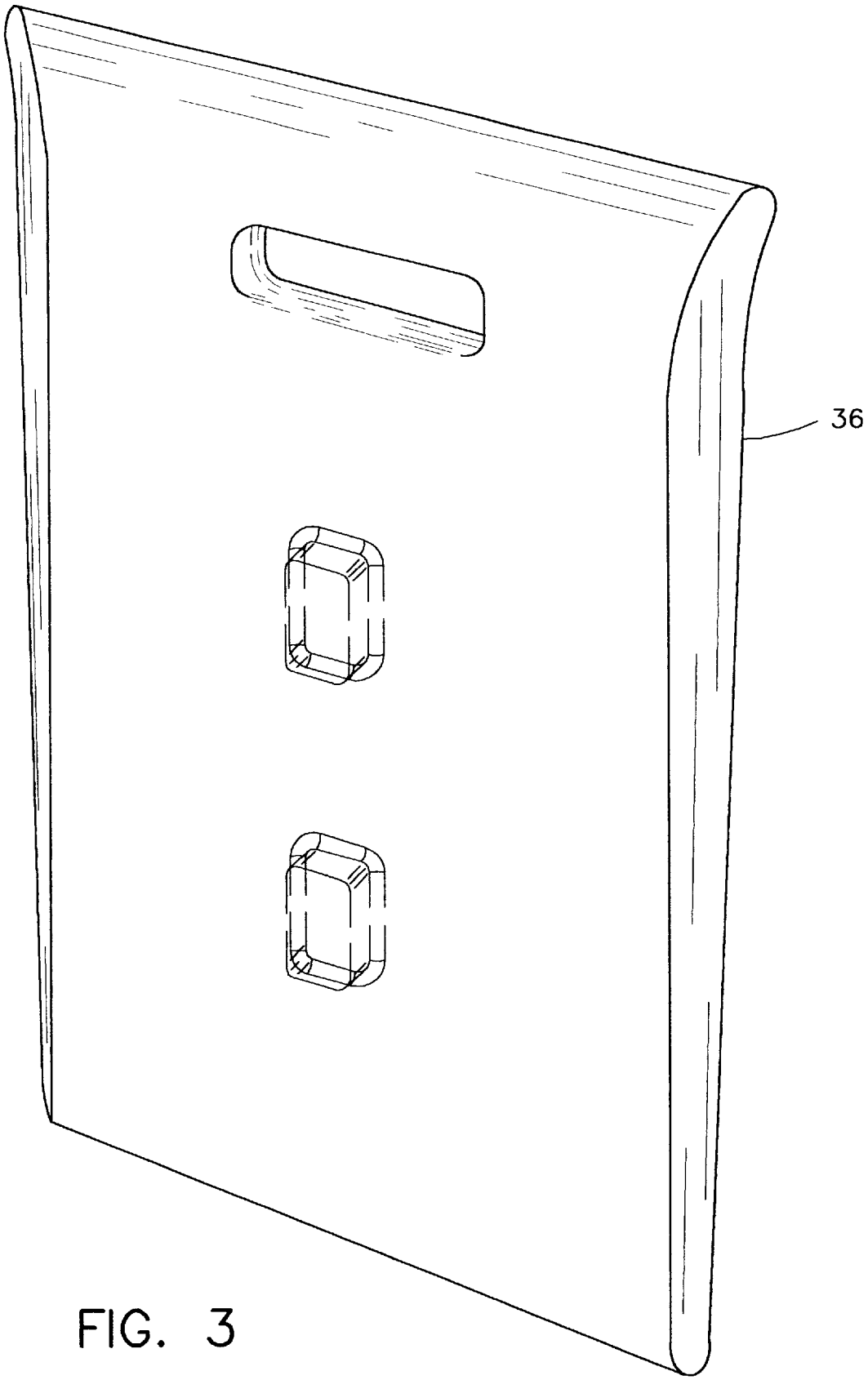
FIG. 3 is a perspective view of a panel component of the embodiment of FIG. 1.
Figure 4:
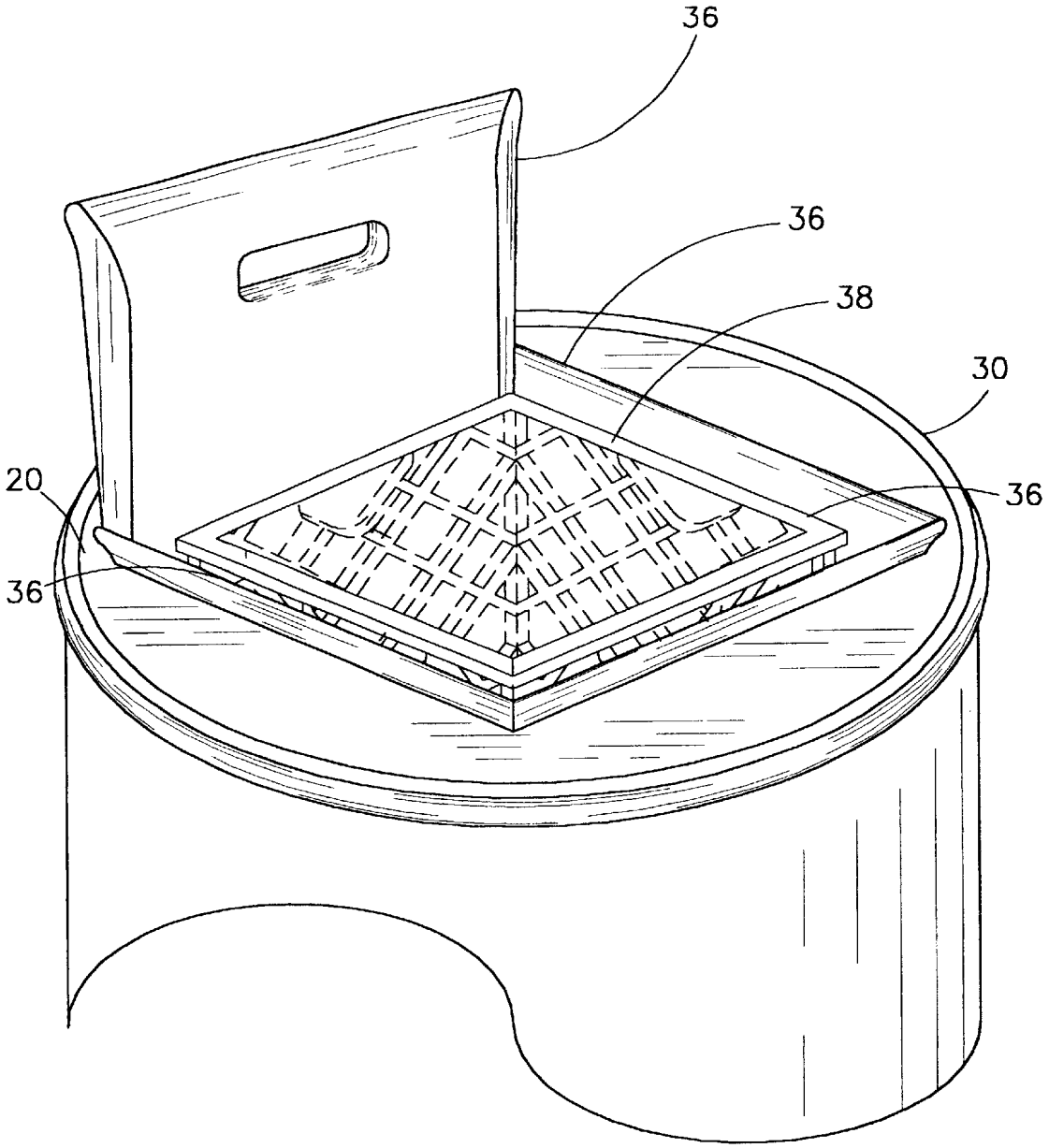
FIG. 4 is a perspective view of the embodiment of FIG. 1 showing the process of replacing panels.

In the embodiment of FIG. 1, each freezer panel 36 preferably is formed so four panels define a periphery in contact with the entire upright inner surface of the inner liner 14. As shown in FIG. 3, each freezer panel preferably is trapezoidal, but nearly rectangular, about 16 inches wide by 22¾ inches high. Each panel 36 is preferably mitred along each vertical edge to form a complementary fit with other adjacent panels. Also, each panel 36 is preferably wider at the top than at the bottom by approximately 1 inch, and gradually decreases in thickness toward the bottom by approximately ⅝ inch, having a syncline profile. Each panel 36 preferably is formed with a handle 42 and a plurality of bosses 44 at which the front and rear faces of the panel are joined to prevent bowing or other panel distortion as the liquid inside expands upon freezing. FIG. 3 illustrates a panel 36 with six indentations of about 1½ inches in diameter with a depth of between about ⅞ to about ⅝ inch, dependent upon placement of the indentation due to the varying thickness of the panel 36.

As shown in FIG. 1, preferably four freezer panels 36 fit together to form the inner surface of the server 10. Thereafter, two conventional milk crates 38, each carrying 48 half-pint milk cartons are vertically stacked into the server 10. The freezer panels 36 are removable and replaceable with freshly frozen panels, even while the milk crates 38 remain within the server 10, without disturbing the milk crates or their contents.

As shown in FIG. 1, preferably casters 40 are mounted to the bottom of the outer barrel 12 to ease mobility of the server 10. Also in FIG. 1, the server 10 is illustrated with graphics 46. For example, light gauge styrene sheeting may be printed, wrapped, and secured to the outer barrel 12.

The server 10 provides an improved display for the sale of milk in school cafeterias. The server 10 maintains the milk at an effective temperature for safe storage and consumption. The server provides sufficient cooling of milk without the need for ice or electricity. Further, the convenient and accessible nature of the server provides an attractive inducement for purchasing milk products.

Although the preferred embodiment just described concentrates on the sale of milk in school cafeterias, the invention is not limited thereto. Other vendors may profit from this server 10 as well. For example, the server 10 may be used in a grocery or convenience store with suitable graphics 46 to display various products. The server 10 allows for the independent display of dairy products apart from other beverages to highlight the nutritional nature of dairy products, in general. In addition, the server 10 allows vendors of other beverage products, such as soda, to place the beverages in an attractive and competitive display without the need for ice or electricity.

Figure 7:
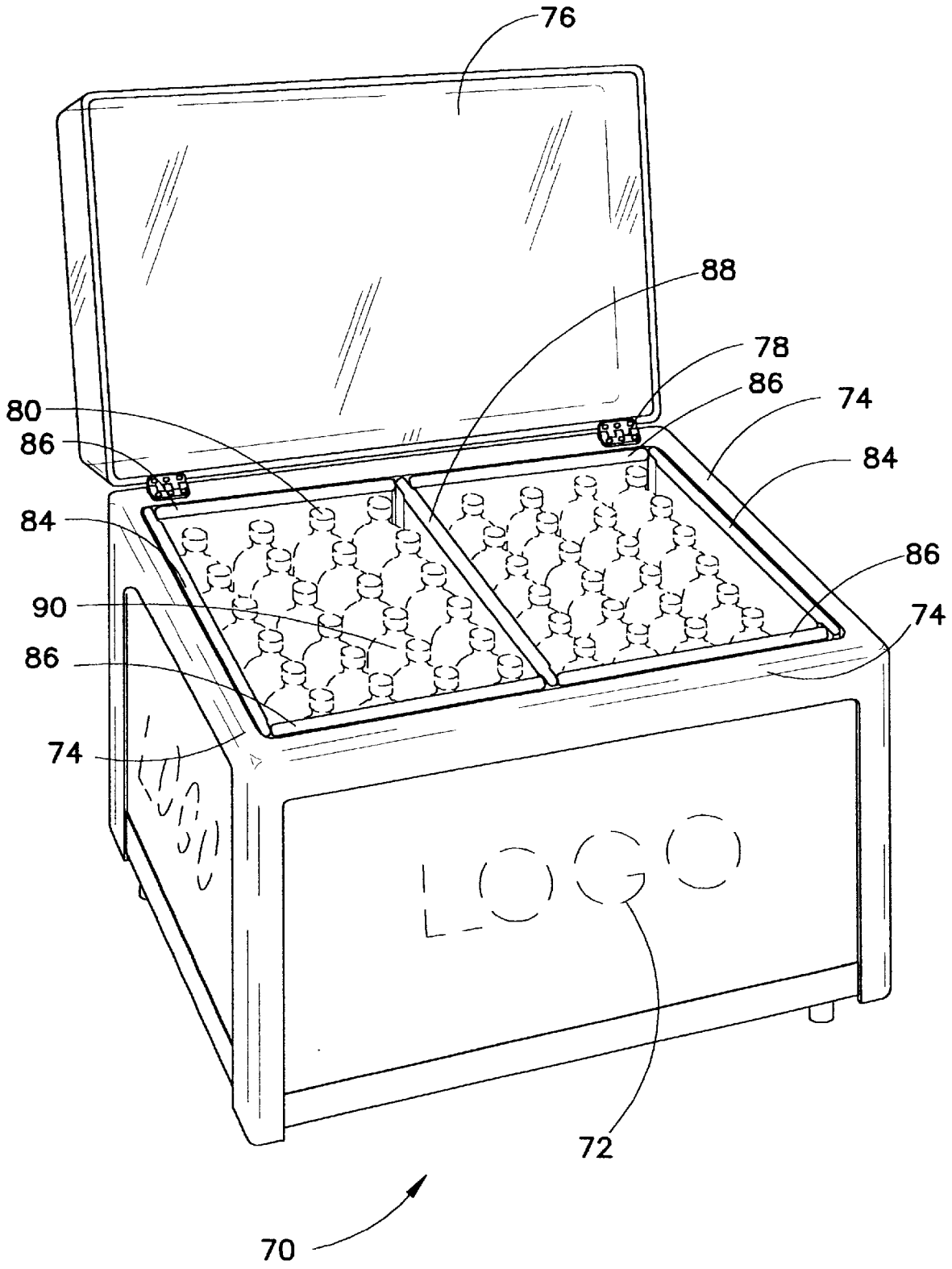
FIG. 7 is a perspective view of a chilled item server in accordance with a second embodiment of the invention.
Figure 8:
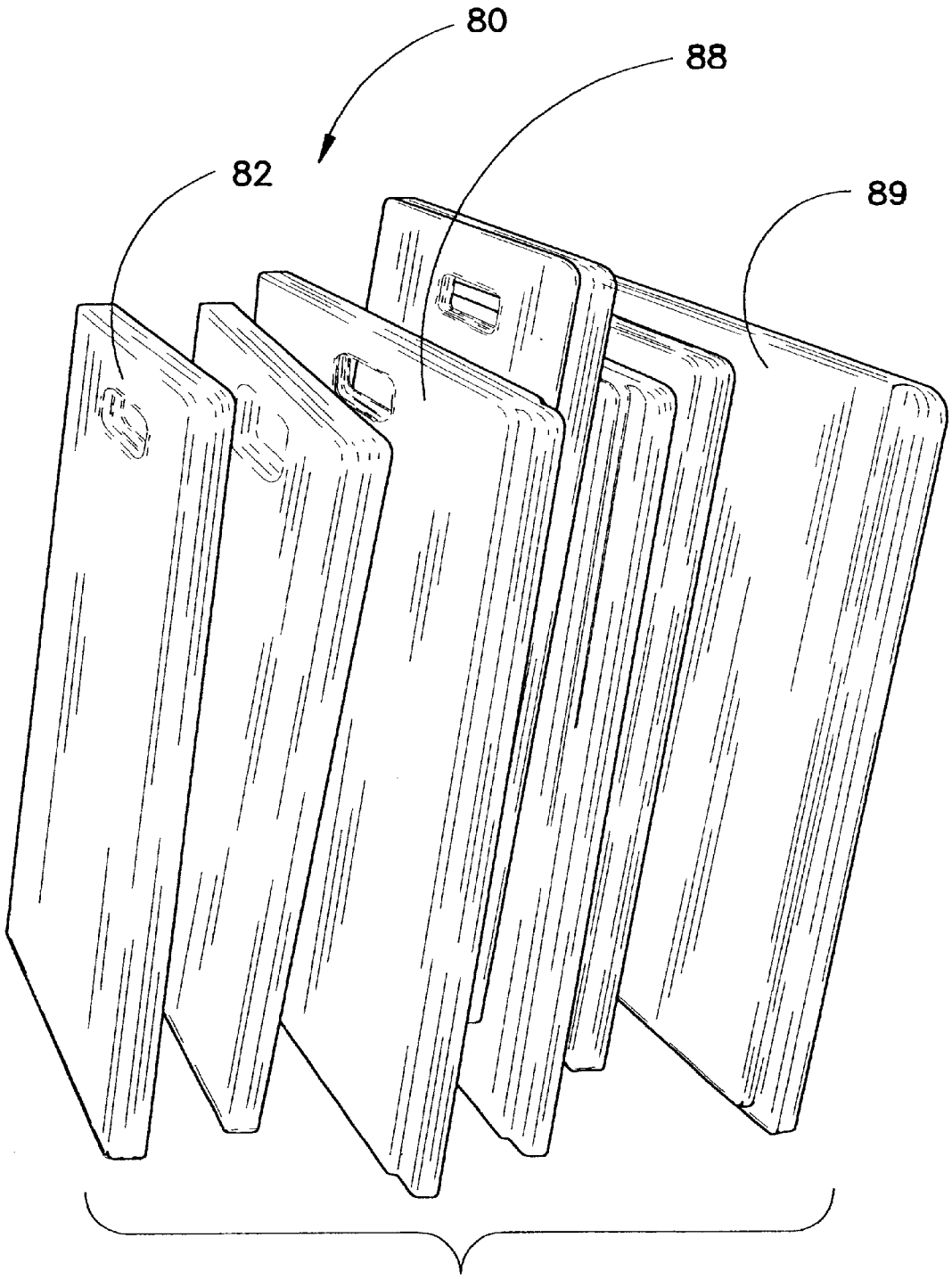
FIG. 8 is a perspective view of panels for the embodiment of FIG. 7.
Figure 9:
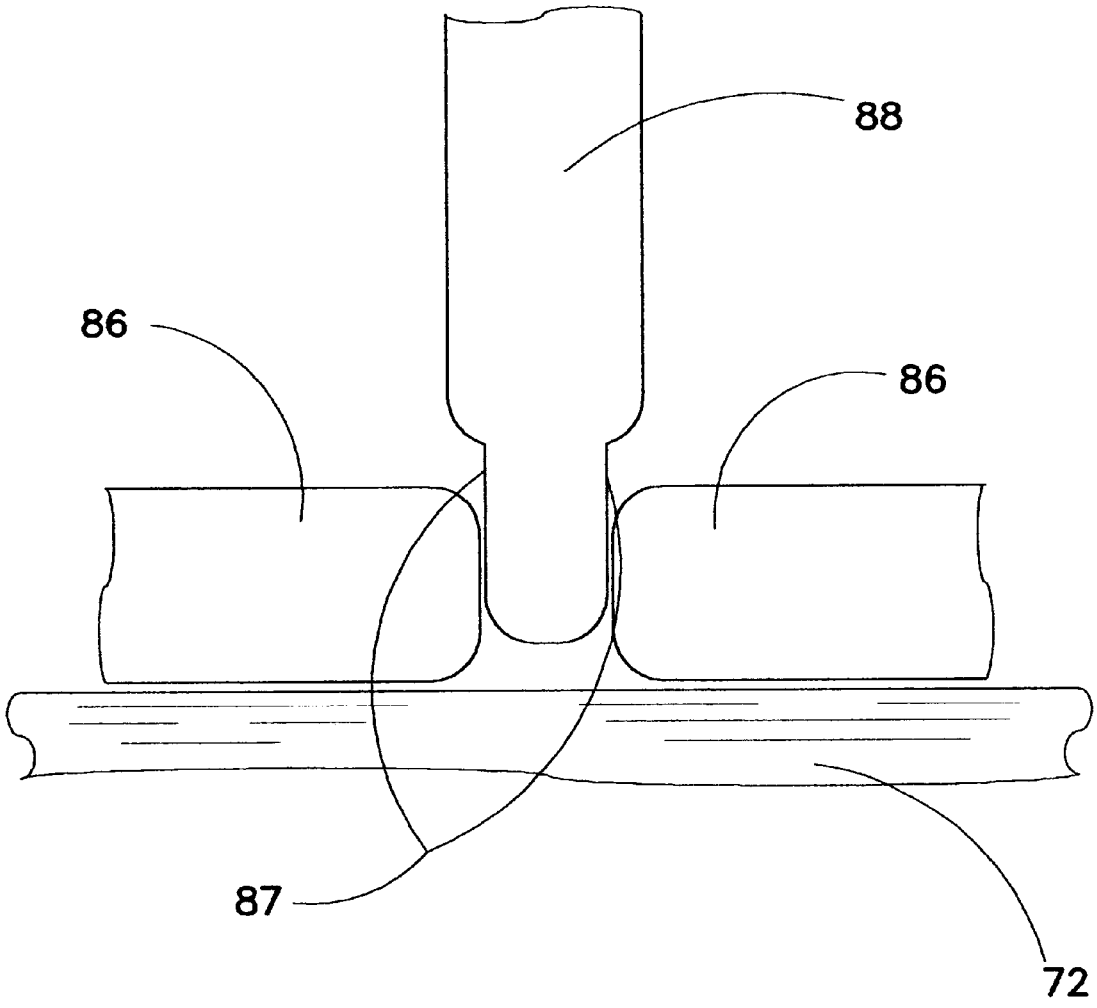
FIG. 9 is an enlarged perspective view of the way panels meet in the embodiment of FIG. 7.

Indeed, the embodiment shown in FIGS. 7–9 is a further refinement of the embodiment of FIG. 1 to focus on retail sales, such as in convenience stores.

As seen in FIG. 7, a chilled item server 70 includes a vessel 72 made up of insulating outer walls to make up a chest. The side walls 72 of the vessel contain thermally insulating material, like the insulating walls defined above. Any of the insulating materials described above or known to those of ordinary skill in the art may be used. The outer wall can be configured and constructed using the techniques described above with respect to FIG. 1, but configured to make a rectangular-shaped chest, again mounted on casters (not shown). A lid 76 is hingedly mounted as at 78 to provide protection for the contents of the vessel and to minimize the escape of cold air.

Within the vessel 72, a plurality of panels 80 are provided. The panels 80 are provided of the same material and with similar contents to the panels 36 described above, and use the same construction techniques. The panels 80 are better seen in FIG. 8 as having handles 82 for easy removal and replacement of the panels in the vessel 72. As seen in FIG. 8, seven panels are provided to be sized for location within the vessel 72, with one panel at each end 84 and two panels 86 along each of the longer sides of the vessel 72. The panels 86 do not extend the full length of the side of the vessel into which they are located, leaving a gap for the end of the panel 88, which then extends substantially fully between the opposed sides of the vessel 72. The ends of the panel 88 have reduced thickness by way of indentations 87 to receive the panels 86. Panel 88 is installed extending between two sides of the vessel 72 with the indentations 87 between the ends of the panels 86 on both sides of the vessel 72. End panels 84 may be similarly shaped to hold the panels outward at the comers of the vessel.

The interfitting of panels 88 and 86 is better seen in FIG. 9, in which the indented or tapered ends on the panel 88 can be seen to cooperate with the side 72 of the vessel to define a groove to maintain the ends of the panels 86 in position. The panels are configured so that when installed in the vessel, they fit together to form vertical walls about at least one interior chamber in the vessel. As seen in FIG. 7, two interior chambers are defined; the invention contemplates several possible numbers of such chambers, including one chamber, in which case all of the panels would form outer boundary walls for the single chamber.

The various panels 80 can be placed into the vessel 72 to define a perimeter and a bisection, thus defining two interior cavities into which food items 90, such as bottled soft drinks, can be placed. Of course, other comestibles such as sandwiches, milk, or other food items can be stored in vessel 72 for presentation to a customer at a retail environment. As used herein, "food items" includes beverages as well as solid food.

Furthermore, it is understood that the vessel 72 can be used in environments other than retail to provide cooled storage of beverages or other food items.

As seen in FIG. 8, the beverages or other food items are located into the vessel within the confines of the chamber. Conventional soft drink racks may be used to organize the bottled beverages in layers. Or, the containers of food items can be loaded into the server in crates. Although the soft drinks or other food items are preferably chilled prior to location in the vessel, they may be installed at room temperature and chilled by the panels 80. As will be appreciated, the entire display will be maintained colder for a longer period of time if the food items are pre-chilled.

The vessel 72 has a floor, which may be insulated or not, as desired. It is also within the scope of the invention for the floor of the vessel 72 to be spaced well above the bottom of the vessel, so that a customer need not reach in and retrieve a food item from the very bottom of the vessel. If so, the resulting air space between the bottom of the vessel and the floor of the vessel on which the food items rest can be made insulating by the addition of a foam material or by being left as an open void into which little convective air flow is likely.

As seen in FIG. 7, the outside of the server 10 can be provided with any suitable material or mechanism to receive promotional graphics for the merchandising of the chilled food items held within.

In a test use of the embodiment of FIG. 1, the half-pint milk cartons were loaded into the interior chamber while chilled to about 35 degrees Fahrenheit, and the panels were loaded after freezing overnight (approximately 16 hours) in a freezer that chills to 25 degrees Fahrenheit. The milk containers stayed within two degrees Fahrenheit for 27 hours. They remained below 41 degrees Fahrenheit for 37 hours, and after 44 hours had only warmed to less than 45 degrees Fahrenheit.

As time goes by, the influx of heat causes the melting of the liquids within the panels 80 and their gradual warming above suitable temperatures. At this time, the panels can simply be removed by grasping the handles 82 and pulling straight up, without interfering with the food item contents within the vessel 72. The panels can be taken to a freezer to be refrozen. Freshly frozen panels can be slipped into place to maintain the coldness within the vessel 72. A commercial unit may be sold with two sets of panels, so one set can be refrozen while the other set is in use. Typically, the thawed panels will be taken to a freezer within the building where the vessel is located for refreezing. The freezer may be quite independent of the vessel 72. There is no need for uncomfortable handling of ice, and messes and sanitation risks of melt water are eliminated.

With the use of the apparatus, a method of selling chilled food items is provided. The insulated vessel can be located in a retail location. The panels can be chilled until the liquid within them freezes, after which the chilled panels are placed into the insulated vessel in a pattern to form vertical walls about at least one interior chamber in the vessel. Then, containers of food items to be sold can be loaded into the interior chamber where they are kept cold by their proximity to the panels for an extended period of time so that they are available to customers in the retail location. Of course, the placement of the panels into the vessel can follow the loading of the containers of food items. Customers can then be permitted to remove containers of food items from the vessel and pay for them. Note that the customers removing the food items are not encountering melt water or ice, which they might contaminate with germs or dirt from their hands.

In the embodiment shown in FIG. 7, some 96 bottles of soft drinks can be loaded, two layers each of 24 bottles in each of the chambers formed within the vessel 72. A smaller, single-chamber size unit can be provided to hold two stacks of 24 bottles each, for a total of 48 bottles.

Since the server 10 is provided mounted on casters, it can be moved about as desired within the retail location, not hampered by electrical connections or fear of spillage of melt water.

The invention provides a means for holding food items, and two specific configurations of such have been shown, including the server 10 of FIG. 1 and the server 70 of FIG. 7. Those of ordinary skill in the art will be able to devise numerous equivalents to these specific structures, which provide insulation and sufficient structural strength to house the desired contents. The means for cooling and maintaining the food items at an effective temperature for consumption without using ice or electricity include the peripherally mounted panels, whether of the tapered configuration shown for the server 10 of FIG. 1 or the panels shown in FIG. 8. Other configurations of such refreezable panels will certainly be apparent to those of ordinary skill in the art as equivalents.

Also, although the vessel 72 is shown as a quadrilateral (rectangular) shape, other shapes, including, without limitation, triangular, trapezoidal, and pentagonal, can be used, as long as the panels are designed to go into the vessel to define a chamber to receive the food items to be chilled.

Additionally, products other than food items can be stored in the vessel, such as blood collected at blood banks, or any other product for which cold storage is desired.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A method of selling chilled food items comprising:

locating an insulated vessel in a retail location, chilling a plurality of removable panels, each of which contains a material that is liquid at room temperature and has a freezing point of about 32 degrees Fahrenheit or colder until the liquid freezes, placing the chilled panels in the insulated vessel in a pattern to form vertical walls around at least one interior chamber in the vessel, loading containers of food items to be sold into the interior chamber, keeping the containers of food items cold by proximity to the panels for an extended period of time so that they are available to customers in the retail location, permitting customers to remove containers of food items from the vessel and pay for them, and replacing a thawed panel with a frozen panel without disturbing the containers of food items.

2. A method of selling chilled food items as claimed in claim 1 further comprising maintaining a lid over the chilled panels and containers of food items in the vessel while the containers are available to the customers.

3. A method of selling chilled food items as claimed in claim 1 wherein the retail location is at a temperature of 75 degrees Fahrenheit or less, the food items are loaded in the interior chamber while chilled to 32–35 degrees Fahrenheit, the panels are frozen overnight in a 25 degree Fahrenheit freezer, and the food items are kept at a temperature within two degrees Fahrenheit for at least 24 hours.

4. A method of selling chilled food items as claimed in claim 1 wherein the retail location is at a temperature of 75 degrees Fahrenheit or less, the food items are loaded in the interior chamber while chilled to 32–35 degrees Fahrenheit, the panels are frozen overnight in a 25 degree Fahrenheit freezer, and the food items are kept at a temperature below 41 degrees Fahrenheit for at least 37 hours.

5. A method of selling chilled food items as claimed in claim 1 wherein the retail location is at a temperature of 75 degrees Fahrenheit or less, the food items are loaded in the interior chamber while chilled to 32–35 degrees Fahrenheit, the panels are frozen overnight in a 25 degree Fahrenheit freezer, and the food items are kept at a temperature below 45 degrees Fahrenheit for at least 44 hours.

6. A method of selling chilled food items as claimed in claim 1 wherein the food items are bottled beverages and the loading step includes loading at least 48 bottles.

7. A method of selling chilled food items as claimed in claim 1 wherein the food items are bottled beverages and the loading step includes loading at least 96 bottles.

8. A method of selling chilled food items as claimed in claim 1 further comprising displaying promotional graphics on an outer surface of the vessel to identify and promote the sale of the contents of the vessel.

9. A method of selling chilled food items as claimed in claim 1 wherein the chilling of the plurality of removable panels takes place in a freezer location separate from the retail location but within the same building as the retail location.

10. A method of selling chilled food items as claimed in claim 1 further comprising:

moving the vessel on casters on the bottom thereof.

11. A method of selling chilled food items comprising:

locating an insulated vessel in a retail location, chilling a plurality of removable panels, each of which contains a material that is liquid at room temperature and has a freezing point of about 32 degrees Fahrenheit or colder until the liquid freezes, placing the chilled panels in the insulated vessel in a pattern to form vertical walls around at least one interior chamber in the vessel, loading containers of food items to be sold into the interior chamber, keeping the containers of food items cold by proximity to the panels for an extended period of time so that they are available to customers in the retail location, and permitting customers to remove containers of food items from the vessel and pay for them, wherein the vessel is quadrilateral and placing the chilled panels in the insulated vessel includes placing two panels on opposed vessel ends, two panels each on opposed vessel sides and one panel extending between the vessel sides spaced from each vessel end and interfitting the panel extending between the vessel sides with the panels on each opposed vessel side.

12. A method of storing chilled food items comprising:

chilling a plurality of removable panels in a freezer location, each of the panels containing a material that is liquid at room temperature and has a freezing point of about 32 degrees Fahrenheit or colder, until the liquid freezes, placing the chilled panels in an insulated vessel separate from the freezer location in a pattern to form vertical walls about at least one interior camber in the vessel, loading containers of food items into the interior chamber, keeping the containers of food items cold by proximity to the panels for a period of time desired for storage, removing selected containers of food items from the vessel, and replacing a thawed panel with a frozen panel without disturbing the remaining containers of food items.

* * * * *